US007044206B2

(12) United States Patent
Sabin et al.

(10) Patent No.: US 7,044,206 B2
(45) Date of Patent: May 16, 2006

(54) HEAT EXCHANGER PLATE AND A PLATE HEAT EXCHANGER

(75) Inventors: Dominique Sabin, Mellecey (FR); Alain Bourgeon, Fontaines (FR); Pierre-Xavier Bussonnet, Chalons-sur-Marne (FR); Eric Gilbert-Desvallons, Saint Marcel (FR); Gilbert Graille, Chatenoy le Royal (FR); Pierre Tanca, Sainte Helene (FR)

(73) Assignee: Packinox, Courbevoie (FR)

( * ) Notice: Subject to any disclaimer, the term of this patent is extended or adjusted under 35 U.S.C. 154(b) by 0 days.

(21) Appl. No.: 10/698,361

(22) Filed: Nov. 3, 2003

(65) Prior Publication Data

US 2004/0188074 A1 Sep. 30, 2004

(30) Foreign Application Priority Data

Dec. 5, 2002 (FR) ..... 02 15373

(51) Int. Cl.
*F28F 3/04* (2006.01)

(52) U.S. Cl. ..... 165/166; 165/167

(58) Field of Classification Search ..... 165/166, 165/167

See application file for complete search history.

(56) References Cited

U.S. PATENT DOCUMENTS 4,678,030 A * 7/1987 Almqvist ..... 165/166
6,702,005 B1 * 3/2004 Blomgren ..... 165/166

FOREIGN PATENT DOCUMENTS

| | | |
|---|---|---|
| DE | 3301211 | 7/1984 |
| EP | 1191297 | 3/2002 |
| GB | 1339542 A1 * | 12/1973 |
| WO | WO-9419657 | 1/1994 |

* cited by examiner

*Primary Examiner*—Allen J. Flanigan
(74) *Attorney, Agent, or Firm*—Connolly Bove Lodge & Hutz LLP

(57) ABSTRACT

The heat exchanger plate presents first adjacent first corrugations generally directed along respective alignment axes in the longitudinal direction of the plate and comprising successive segments that are substantially rectilinear and oblique, being successively inclined in a first sense and in a second sense relative to the longitudinal axis. The heat exchanger plate also has at least one deformation zone constituted by at least one set of segments of second corrugations of generally transverse direction intersecting the set of longitudinal axes along which the first corrugations are disposed. The alignment axes of the segments of second corrugations make an angle lying in the range 45° to 90° with the longitudinal axes of the first corrugations.

9 Claims, 6 Drawing Sheets

HEAT EXCHANGER PLATE AND A PLATE HEAT EXCHANGER

The invention relates to a heat exchanger plate and to a plate exchanger made up of plates of the invention.

BACKGROUND OF THE INVENTION

Heat exchangers are known that are used, for example, in the petrochemicals industry or oil refining, which are made in the form of plate heat exchangers and which serve to exchange heat with very good efficiency between a hot fluid and a cold fluid, with the cold fluid being subjected to a temperature rise of the order of 300° C. to 400° C., for example.

In such applications, plate heat exchangers have the advantage of presenting a very good coefficient of heat exchange.

In general, such heat exchangers comprise one or more bundles of plates each constituted by a stack of superposed plates that extend parallel to one another and that define between them two totally separate flow circuits for two fluids.

Each of the individual plates in a plate heat exchanger bundle is constituted by a fine metal sheet, e.g. made of stainless steel, that is shaped so as to have corrugations of a special shape in a central zone of the plate, through which heat is transferred between the fluids.

The corrugations of the plates in the heat exchanger bundle are disposed so as to be adjacent to one another and cover the entire surface area of the central zone of the heat exchanger plate. The corrugations may be directed in a longitudinal direction of the plate which constitutes a general flow direction for the fluids between which heat is exchanged.

By way of example, the fluids may be caused to flow as counterflows, i.e. in directions that are parallel but in senses that are opposite on opposite sides of the plates stacked one above another in the heat exchanger bundle.

The corrugations of each plate directed along a longitudinal axis of the plate between an inlet end portion and an outlet end portion of the plate, themselves comprise substantially rectilinear segments following one another in the longitudinal direction and extending obliquely relative to said plate direction. The successive and oblique segments are inclined relative to the longitudinal axis of the plate along which they are disposed successively to one side and to the other side of the longitudinal axis so as to constitute a zigzag line. The adjacent corrugations constitute ridge lines in a first face and also in an opposite second face of the heat exchanger plate.

The plates of a plate heat exchanger bundle that are stacked one on another are disposed in alternation in first and second dispositions, the stacked plates being turned through 180° face for face relative to the two adjacent plates in the stack. Thus, the plates referred to in alternation as being odd plates and as being even plates present corrugations whose superposed rectilinear segments have orientations that are different. As a result, the plates rest on one another via their corrugations touching in zones of substantially point contact.

The plates stacked on one another in a bundle are generally of rectangular shape and are connected to one another along their longitudinal edges by connection means that provide leaktight closure of the lateral sides of the bundle. Plane sheets disposed at the top and bottom of the stack and fixed to the lateral connection means also serve to close the top and bottom portions of the bundle of plates.

The successive rectilinear segments of the longitudinal corrugations of the heat exchanger plates make obtuse angles relative to one another that are very wide open, each of the successive segments being inclined little relative to the longitudinal axis relative to which it is obliquely disposed.

This disposition of successive segments of the corrugations puts a considerable limit on the ability of the plate to lengthen inside the heat exchanger while it is in operation and under the effect of expansion due to making contact with a fluid at high temperature. The plates are very rigid in the longitudinal direction because of the small inclination between the successive segments of the corrugations.

Stresses of thermal or mechanical origin to which the heat exchanger is subjected therefore need to be absorbed by each of the plates in the plate heat exchanger and also by the entire bundle of plates in the assembled state.

This can lead to excessive stresses in the plates which are fine metal sheets and also in the structures of the bundle and of the heat exchanger.

OBJECTS AND SUMMARY OF THE INVENTION

The object of the invention is thus to propose a heat exchanger plate constituted by a stack of plates, each having a central zone in which the plate presents adjacent first corrugations extending generally along respective axes in the longitudinal direction of the plate and being made up of successive substantially rectilinear segments that are oblique relative to their longitudinal axis, being inclined successively to one side and to the other side of the longitudinal axis, said plate enabling plate deformation of thermal or mechanical origin in the heat-exchanger in operation to be absorbed and thus limiting the stresses to which the plate is subjected and to which the structure of the heat exchanger is subjected.

For this purpose, the heat exchanger plate of the invention further includes at least one set of successive segments of second corrugations disposed angularly or in alignment and extending along an alignment axis having a generally transverse direction, intersecting the set of longitudinal axes along which the first corrugations are disposed, the transverse alignment axes of the substantially rectilinear segments of the second corrugations making respective angles lying in the range 45° to 90° with the longitudinal axes of the first corrugations.

In particular embodiments of the invention:

- the second corrugations of generally transverse direction intersect the first corrugations in zones of the rectilinear segments of the first corrugations that are situated between the ends of said segments;
- the second corrugations intersect the first corrugations in junction zones between successive segments of the first corrugations;
- the second corrugations are discontinuous and comprise successive different portions in the transverse direction separated by zones in which the heat exchanger plate does not have second corrugations;
- the heat exchanger plate includes at least two deformation zones each constituted by at least one set of second corrugation segments;
- each of the deformation zones has at least two adjacent second corrugations extending in the transverse direction of the heat exchanger plate;

the heat exchanger plate includes a plurality of deformation zones disposed successively in the longitudinal direction of the heat exchanger plate, with constant spacing between pairs of successive deformation zones; and the heat exchanger plate includes a plurality of deformation zones distributed along the longitudinal direction of the heat exchanger plate in such a manner that successive deformation zones are spaced apart in the longitudinal direction by varying distances along the length of the heat exchanger plate.

The invention also provides a plate heat exchanger bundle constituted by a stack of plates of the invention.

Each of the plates of the heat exchanger bundle may have at least two deformation zones disposed in positions such that the deformation zones in the longitudinal direction of two successive plates in the stack are not superposed in the stack of plates of the set of plates.

BRIEF DESCRIPTION OF THE DRAWINGS

In order to make the invention well understood, there follows a description by way of example and made with reference to the accompanying figures of a plurality of embodiments of a heat exchanger plate in accordance with the invention and a plate heat exchanger bundle comprising a stack of plates in accordance with the invention.

MORE DETAILED DESCRIPTION

Figure 1:
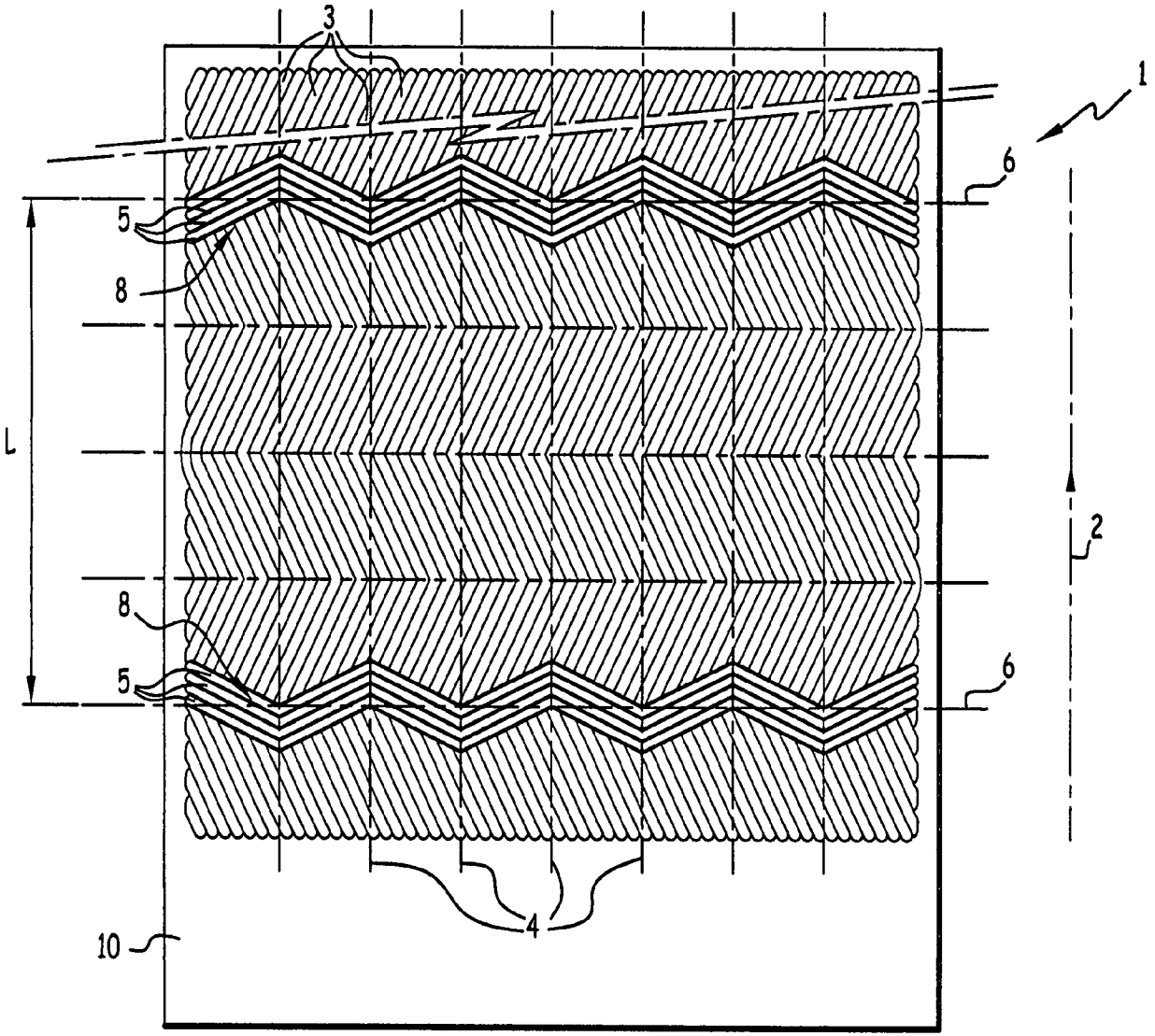
FIG. 1 is a plan view showing first and second corrugations of a heat exchanger plate in accordance with the invention.

FIG. 1 shows a segment of a plate 1 of a plate heat exchanger made in accordance with the invention.

The plate 1 is obtained from sheet metal, e.g. stainless steel, on which a forming operation is performed to obtain corrugations.

In FIG. 1, an arrow shows the sense in which a fluid flows along the longitudinal direction 2 of the plate 1, e.g. in contact with its top face that is visible in FIG. 1, which figure shows a segment of a heat exchanger plate extending in the longitudinal direction 2.

The plate 1 has a first set of corrugations 3 or longitudinal corrugations disposed generally in the longitudinal direction 2 of the plate, each of the corrugations 3 comprising successive segments that are substantially rectilinear and disposed obliquely relative to the direction of an axis 4 extending in the longitudinal direction of the plate 1.

In FIG. 1, there can be seen a plurality of longitudinal axes 4 along which the longitudinal corrugations 3 are aligned. As can be seen in FIG. 1, the successive rectilinear segments of the first corrugations 3 in the longitudinal general direction are inclined relative to the longitudinal axes 4, preferably by an angle lying in the range 10° to 30°. Two successive segments of a corrugation 3 extend in a first sense and in a second sense relative to the axis 4, with successive segments making between them an angle that is very open, of the order of 120° to 160°.

As a result, and as explained above, the ability of the plate 1 to deform in the longitudinal direction, e.g. under the effect of thermal expansion due to the plates of the heat exchanger rising in temperature operation, is extremely limited. This gives rise to high levels of stress in the plates 1 of the heat exchanger and in the bundle made by stacking the plates 1.

According to the invention, secondary corrugations 5 are made in each of the plates 1 of the heat exchanger to extend in a transverse direction 6, i.e. aligned in general manner with transverse axes 6 making an angle that can lie in the range 45° to 90° with the longitudinal direction 2 of the axes 4 of the first corrugations. As shown in FIG. 1, the second corrugations 5 may be directed along axes 6 that are perpendicular to the longitudinal axes 4 of the plate 1. The second corrugations 5 comprise successive rectilinear segments each making an angle lying in the range 0° to 30° with the transverse alignment direction 6, two successive segments of a corrugation 5 being oriented in a first sense and in an opposite second sense relative to the transverse alignment direction 6. As a result, successive segments of the transverse second corrugations make angles lying in the range 120° to 180° between one another.

The transverse corrugations 5 may be disposed in a plurality of transverse deformation zones 8 each aligned along the direction of a transverse axis 6.

In FIG. 1, two deformation zones 8 are shown that are spaced apart by a distance L in the longitudinal direction 2 of the plate 1.

Depending on the requirements of the plate 1 in longitudinal deformation, the plate may have an arbitrary number of deformation zones 8 made up of transverse corrugations 5.

In general, a heat exchanger plate of the invention must have at least one deformation zone 8 in which at least one transverse corrugation 5 is made so as to constitute both a projecting ridge portion and a recessed furrow portion in both opposite faces of the plate. The deformation zones 8 of the plate 1 preferably comprise a plurality of adjacent corrugations 5, each forming a ridge portion on one of the faces of the sheet and a furrow portion in the other face.

The adjacent longitudinal corrugations 3 themselves form projecting ridge portions and recessed furrow portions in each of the faces of the plate 1, the furrow portions in one of the faces of the sheet constituting the ridge portions in the other face of the sheet.

The deformation zones 8 constituted by the second corrugations 5 intersect the set of axes 4 of the first corrugations 3 of longitudinal direction across the entire width of the heat exchanger plate 1.

As can be seen in FIG. 1, each of the successive segments of a corrugation 5 of a deformation zone 8 makes an angle with the segments of the longitudinal corrugations 3 that it intersects, lying, for example, in the vicinity of 45° or 90°.

In FIG. 1, it can be seen that the successive rectilinear segments of the second corrugations 5 form an angle close to 90° with the segments of the first corrugations that are directed to the left in the figure and an angle close to 45° with the segments of the first corrugations 3 that are directed to the right in the figure.

In general, the successive segments of the second corrugations may make an arbitrary angle with each of the successive segments of the first corrugations that they intersect, said angle lying in the range, for example 30° to 90°.

Because the deformation zones 8 constituted by the second corrugations 5 of transverse direction are disposed across the entire width of the heat exchanger plate 1, deformation in the longitudinal direction of the plate 1 can be absorbed in the deformation zone 8 which presents a degree of flexibility due to the presence of the adjacent corrugations 5.

FIGS. 2A, 2B, 2C, and 2D show four variant embodiments of deformation zones 8 constituted by adjacent transverse corrugations 5 in a plate 1 of a plate heat exchanger. Each of the zones 8 has at least one corrugation 5 of transverse direction, e.g. four adjacent corrugations, as shown in the figures.

Figure 2C:
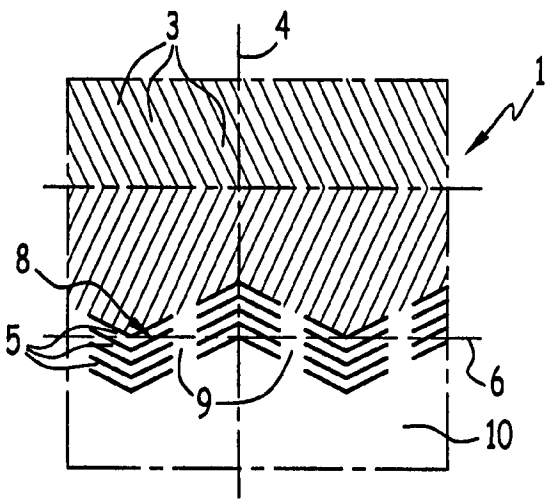
FIGS. 2A, 2B, 2C, and 2D are fragmentary plan views of heat exchanger plates in accordance with the invention constituting first, second, third, and fourth embodiments, respectively.
Figure 2B:
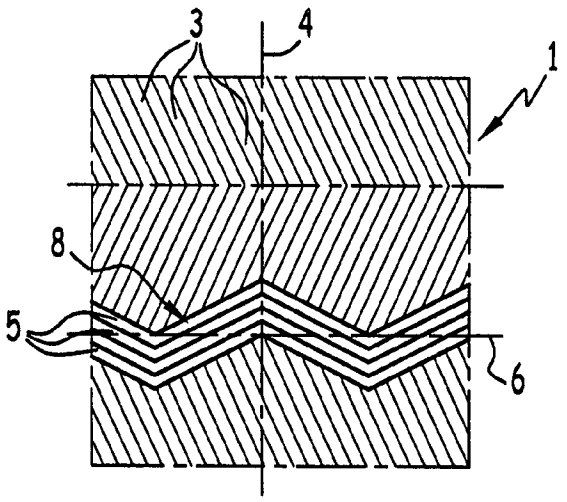
Figure 2A:
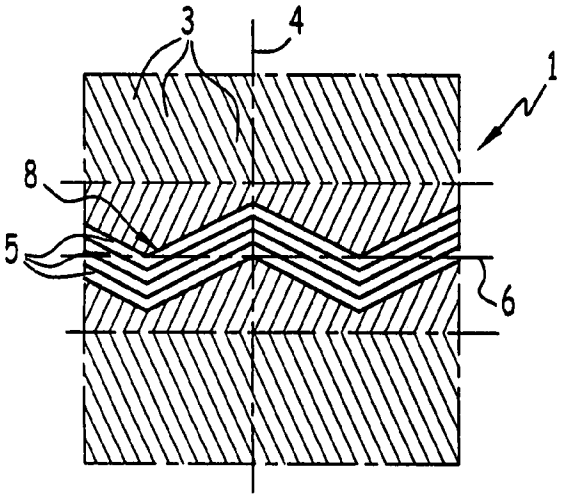

In FIG. 2A, there can be seen a deformation zone 8 constituted by transverse corrugations 5 intersecting the longitudinal corrugations 3, each in a plate of a rectilinear segment of the longitudinal corrugation 3 between the ends of said segment that join adjacent segments disposed angularly in an opposite sense relative to an axis 4.

In FIGS. 2A, 2B, 2C, and 2D, transverse corrugations 5 are shown having alignment axes 6 that are perpendicular to the alignment axes 4 of the longitudinal corrugations. More generally, the axes along which the successive rectilinear segments of the transverse second corrugations 5 are aligned may be at an angle lying in the range 45° to 90° relative to the alignment axes of the successive rectilinear segments of the first corrugations 3.

The rectilinear segments of the second corrugations 5 also make an angle (e.g. close to 60° in FIG. 2A) with the longitudinal axes 4 of the first corrugation 3 of the plate 1.

FIG. 2B shows a variant embodiment for the deformation zones 8 which are constituted by adjacent transverse corrugations 5 intersecting the first corrugations 3 of the plate 1 in junction zones between successive segments of the first corrugations 3 that are disposed angularly relative to each other. The deformation zone 8 is aligned along a transverse axis 6 passing through the junction zones between rectilinear segments of the first corrugations 3, which junction zones are in transverse alignment.

For the deformation zones 8 shown in FIGS. 2A and 2B, adjacent transverse corrugations 5 constituting these deformation zones are continuous along the entire width of the plate 1.

In FIG. 2C, there can be seen a deformation zone 8 constituted by transverse corrugations 5 that present short discontinuities 9, the length of these discontinuities 9 in the transverse direction being shorter than the width of a corrugation 3 in the longitudinal direction, for example. In the discontinuity zones 9, the plate 1 does not have transverse corrugations.

Because of the short length of the discontinuities 9 in the transverse direction, the plate 1 presents flexibility that is substantially analogous to that of the plates 1 shown in FIGS. 2A and 2B.

In addition, FIG. 2C shows an end zone 10 of the plate 1 where fluid is admitted to or leaves the heat exchanger bundle.

In order to direct the heat exchange fluids selectively in channels defined by the longitudinal corrugations, the zone 10 of the plate may have two crossed arrays of corrugations so as to ensure that a first heat exchange fluid on one side of the sheet is distributed amongst the channels, and so as to collect a second heat exchange fluid from the other side of the sheet.

The end zone 10 of the plate may be made, as shown in FIGS. 1 and 2C by a portion of the plate that is completely without any corrugations. Under such circumstances, when making up the heat exchanger bundle by stacking the plates on one another, inlet and outlet zones of the bundle are provided that guide the fluids by means of independent plates inserted between the smooth inlet portions of the plates of the heat exchanger.

As shown in FIG. 2C, the deformation zone 8 can be made in the immediate vicinity of an end portion 10 of the heat exchanger plate 1 at the ends of the longitudinal corrugations 3.

Figure 2E:
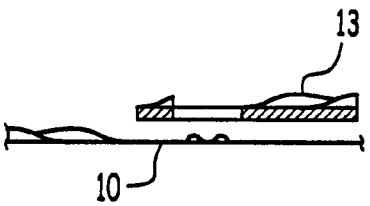
FIG. 2E is a section view on E—E of FIG. 2D showing a stage of assembling the plate in an end zone.
Figure 2D:
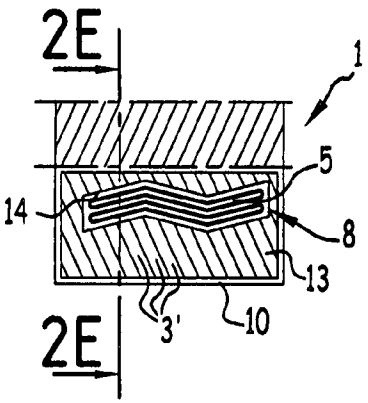

As shown in FIGS. 2D and 2E, the plate 2 of the invention may have an end zone 10 in which the plate 1 presents a deformation zone 8 having transverse corrugations 5. An insert 13 is applied on the sheet 1 in its end portion 10, which insert is located in the heat exchanger between two successive plates. The insert 13 is made in the form of a plate that may have a set of corrugations 3' in a disposition adapted to guide fluids at one of the ends of the heat exchanger. The insert 13 includes a through opening 14 of shape and size adapted to the shape and size of the deformation zone 8 so that the transverse corrugations 5 are received in the opening 14 when the insert 13 is placed on the plate 1. The end portion 10 of the sheet 1 can thus deform in the longitudinal direction and contribute to guiding fluids in the heat exchanger. Instead of deformation zones 8 having juxtaposed transverse corrugations 5, it is possible to provide one or more isolated transverse corrugations in the end portion 10 of the plate 1, which corrugations are received in one or more openings in an insert applied to the plate 1. The transverse corrugations of the end zone may be constituted by segments disposed angularly or in alignment; the shape of the openings in the insert matches the shape of the transverse corrugations.

Figure 4:
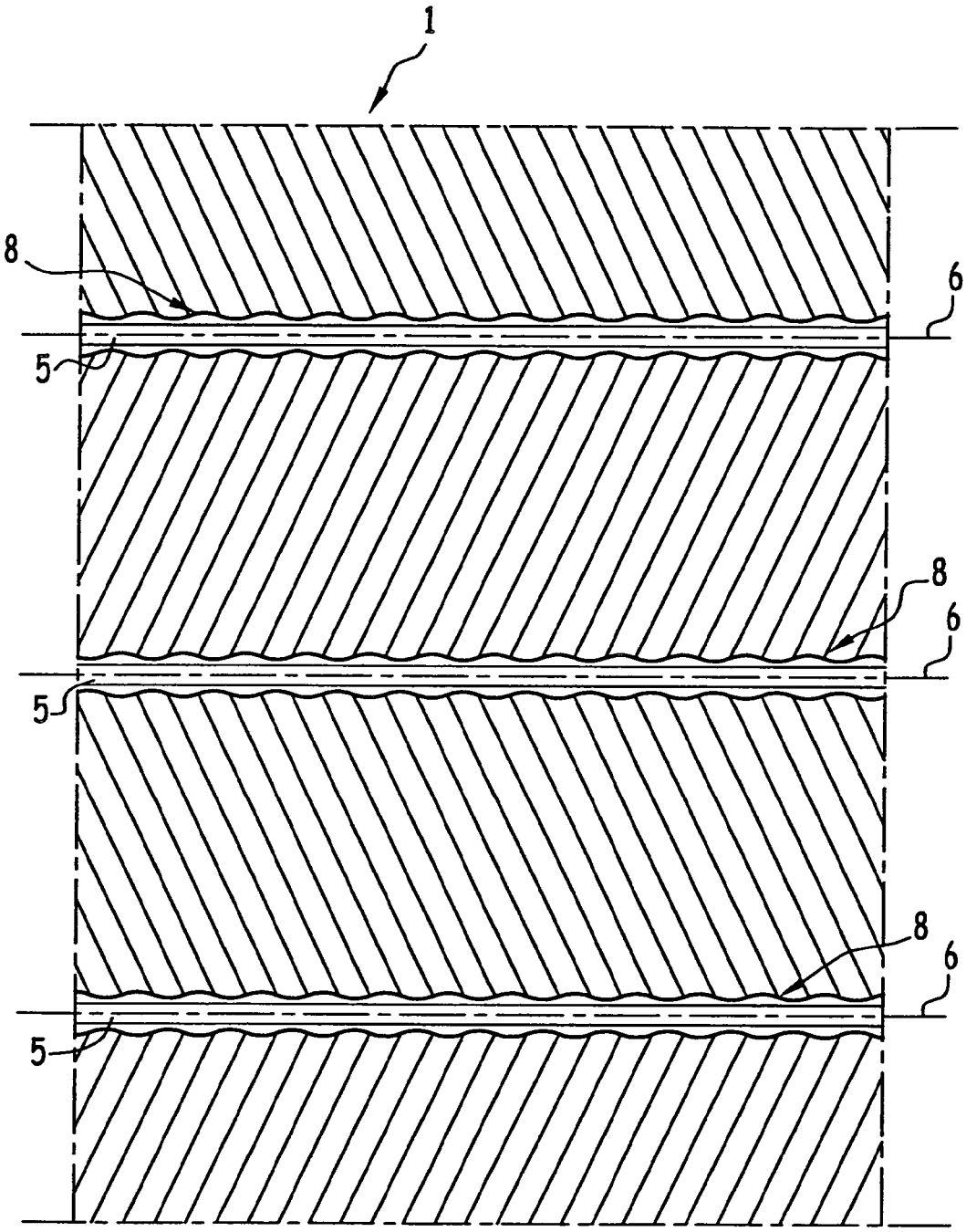
FIG. 4 is a plan view of a heat exchanger plate in accordance with the invention having rectilinear transverse corrugations.

FIG. 4 shows a plate 1 in accordance with the invention having transverse deformation zones 8 each constituted by a single rectilinear corrugation 5 extending along the transverse direction 6 of the plate; in this case, the successive segments that are disposed at angles relative to each other along the transverse corrugations 5 as described above are replaced by aligned segments making a plane angle (180°) between one another.

As shown in FIG. 4, the corrugations 5 may be placed in the angular connection zones of the zig-zag longitudinal corrugations 3 in the plate 1.

As mentioned above, each of the plates 1 of the heat exchanger may have one or more deformation zones 8 providing the heat exchanger plate with flexibility enabling it to deform in the longitudinal direction.

Figure 3A:
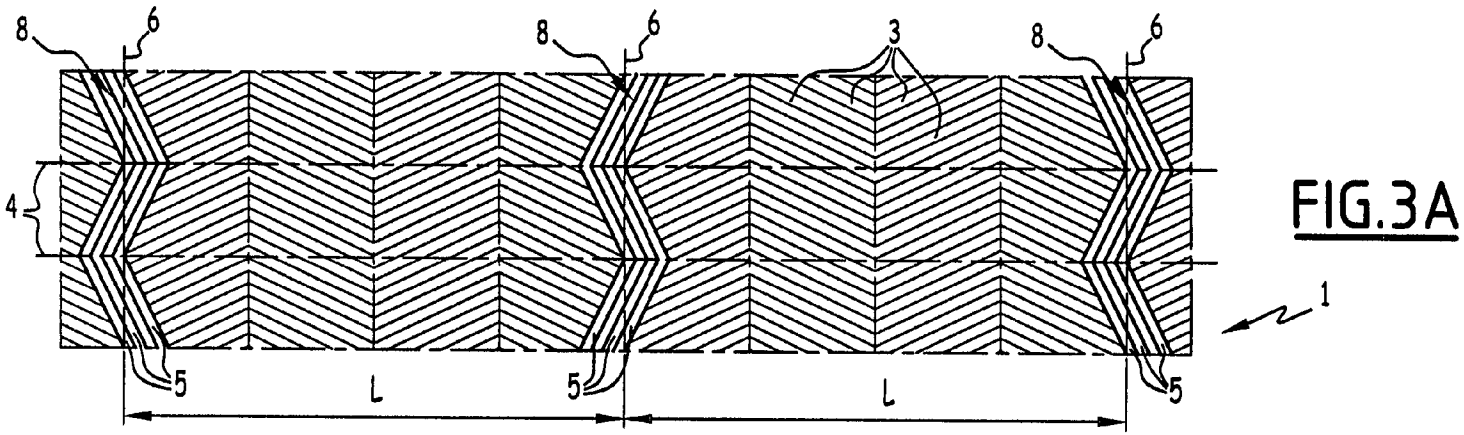
FIGS. 3A and 3B are plan views of heat exchanger plates in accordance with the invention comprising a plurality of sets of second adjacent corrugations having different relative dispositions in the longitudinal direction of the heat exchanger plate.
Figure 3B:
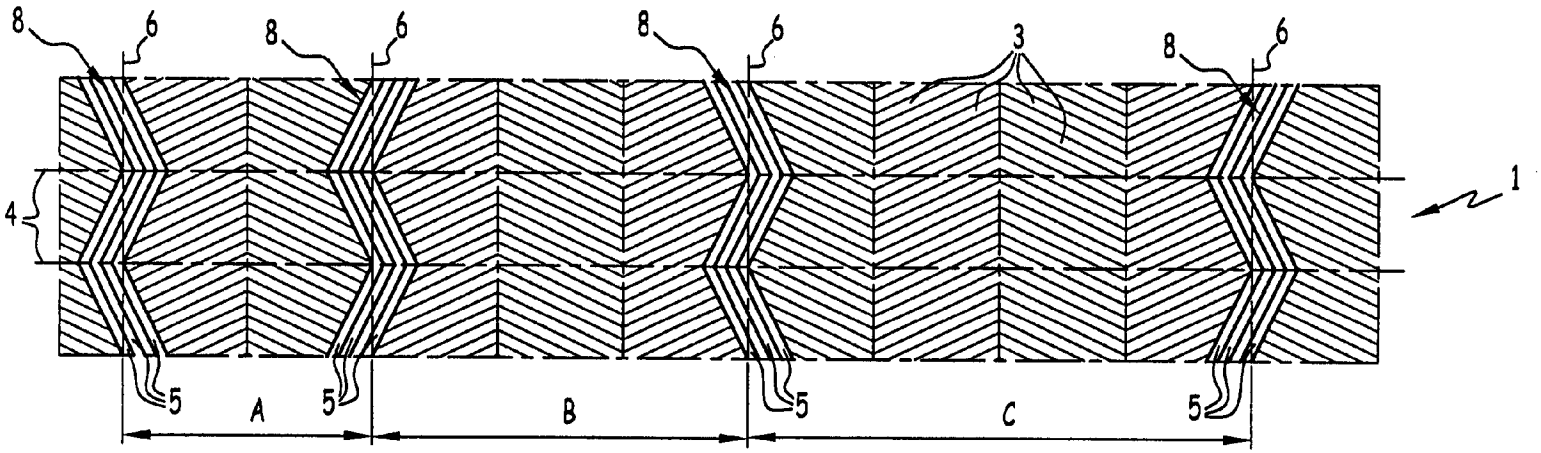

When the plates of the heat exchanger comprise a plurality of deformation zones 8, as shown in FIGS. 3A and 3B, successive deformation zones 8 may be disposed in the axial direction of the heat exchanger plate 1 at equal distances apart from one another (constant distance L in FIG. 3A) or at varying distances in the longitudinal direction (distances A, B, and C where $A \neq B \neq C$, as shown in FIG. 3B).

In general, the transverse alignment direction 6 of the deformation zones 8 may make an angle lying in the range 45° to 90° with the direction of the axes 4 of the longitudinal direction corrugations 3.

A requirement concerning the deformation zones 8 is nevertheless that the deformation zones constituted by the transverse corrugations 5 intersect practically all of the longitudinal corrugations 3 by extending over practically the entire width of the heat exchanger plate 1, and the general direction of the deformation zones must be perpendicular or oblique relative to the longitudinal direction.

Figure 5:
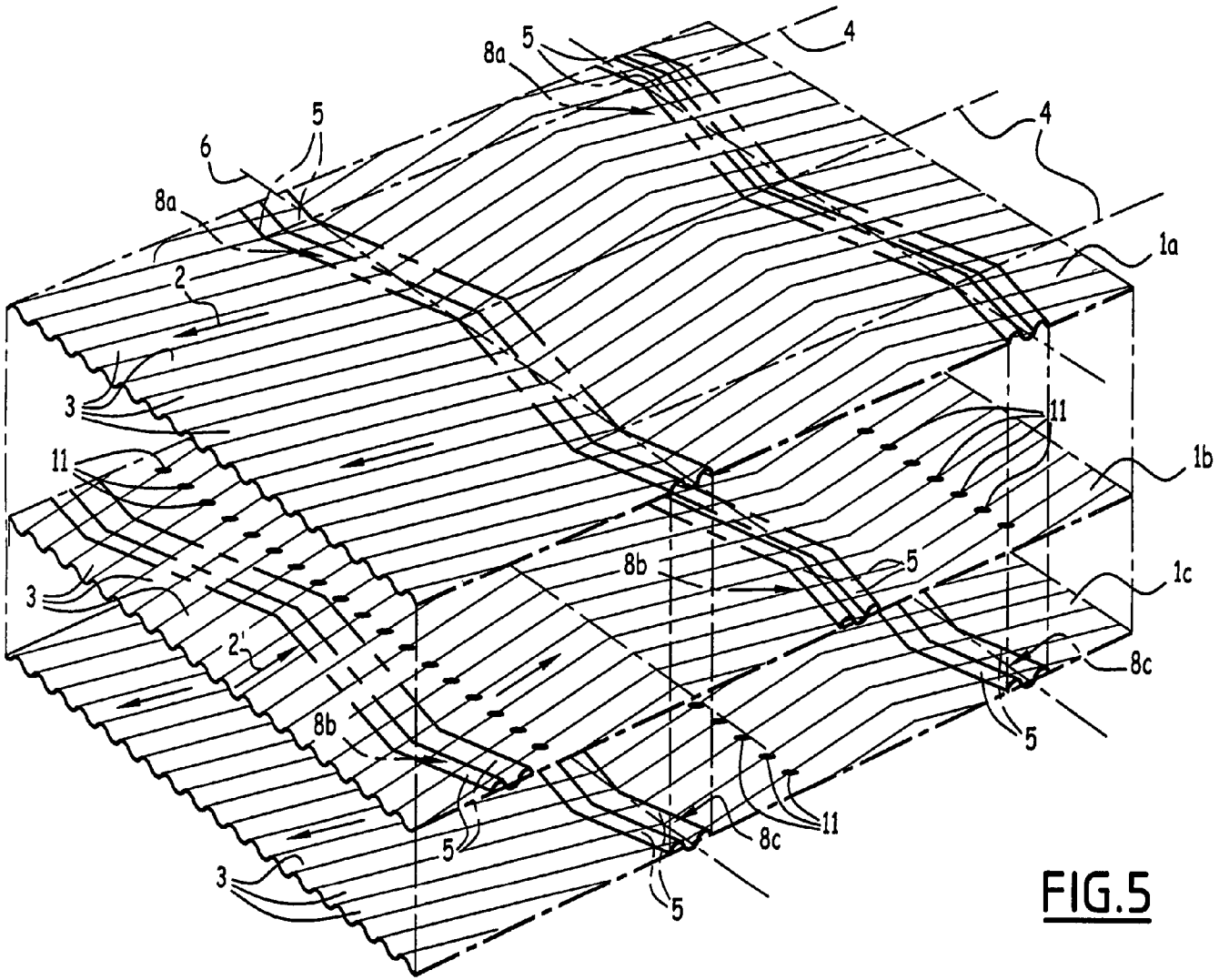
FIG. 5 is an exploded perspective view of a portion of a plate heat exchanger bundle showing the disposition of the transverse deformation zones.

FIG. 5 is an exploded view showing a portion of a plate heat exchanger bundle having plates to which the invention applies.

The heat exchanger plates 1*a*, 1*b*, and 1*c* have longitudinal corrugations 3 whose ridge lines follow zig-zag lines, said ridge lines corresponding to the tops of the corrugations in the top faces of the plates 1*a*, 1*b*, and 1*c*.

The corrugations 3 are constituted by, successive rectilinear segments disposed at angles relative to one another and directed along longitudinal axes 4 of the heat exchanger plates.

The intermediate plate 1*b* is referred to as an "odd" plate and serves to be interposed between two "even" plates 1*a* and 1*c*, being turned through 180° face for face relative to the orientation of the even plates 1*a* and 1*c*. The oblique segments of the corrugations 3 and the ridge lines shown in FIG. 5 are at different orientations on the even plates 1*a* and 1*c* compared with the odd plates 1*b* and therefore come into contact with one another when the sheets 1*a*, 1*b*, and 1*c* are superposed in zones 11 of the longitudinal corrugations that are almost point contact zones.

Figure 6:
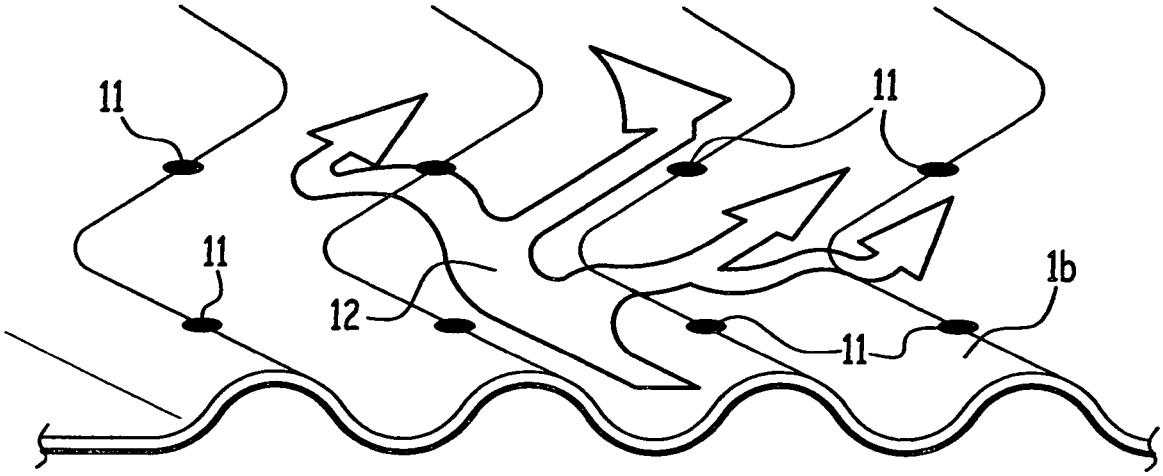
FIG. 6 is a perspective view of a plate of a plate heat exchanger bundle showing the path followed by fluid passing the contact zones of the plate.

FIG. 6 shows the point contact zones 11 of the corrugations in the sheet 1*b* where they contact zones of the sheet 1*a*.

The principle of heat exchangers is to cause a first fluid to flow in a generally longitudinal direction in a first sense (represented by arrow 2) in every other space between two successive sheets in the stack, and to cause a second fluid to flow in the longitudinal direction and generally as a countercurrent to the flow of the first fluid (as represented by arrow 2') in the spaces between the sheets through which the first fluid does not flow, i.e. in every other space between sheets.

For this purpose, in inlet and outlet zones of the sheets, special corrugations or inserts serve to distribute the fluids.

As shown in FIG. 6 by means of arrows 12, the fluids (e.g. the second fluid flowing generally in the direction 2') are distributed by passing between the contact points 11 between the longitudinal corrugations.

When transverse corrugations are made in the heat exchanger plates, these corrugations must be shaped in such a manner as to limit as much as possible any increase in head loss in the flow of fluid through the heat exchanger bundle.

In FIG. 5, the plates 1*a*, 1*b*, and 1*c* are heat exchanger plates of the invention having deformation zones 8*a*, 8*b*, or 8*c* extending transversely over the entire width of the sheets and spaced apart from one another in the longitudinal direction, each of the sheets of the heat exchanger bundle possibly having a plurality of deformation zones 8*a*, 8*b*, 8*c*.

When the segments of the transverse corrugations are at an angle other than 0° relative to the transverse axis 6, the deformation zones 8*b* of the odd intermediate sheet 1*b* are preferably offset in the longitudinal direction relative to the deformation zones 8*a* and 8*c* of the even sheets 1*a* and 1*c*. When the stack is built up, the deformation zones 8*a* and 8*c* of the even sheets and the deformation zones of the odd sheets are offset relative to one another in the longitudinal direction of the sheets in the stack. The deformation zones of all of the even sheets may be in superposed positions, and likewise the deformation zones of the odd sheets can be superposed, however it is also possible to devise other dispositions in which the deformation zones of the even sheets or of the odd sheets are not all superposed.

For a stack of sheets in which all of the deformation zones of the even sheets and all of the deformation zones of the odd sheets are superposed, the resulting stack is characterized by the offset d between the deformation zones of the even sheets and the deformation zones of the odd sheets.

When the transverse corrugation segments are at a zero angle (or plane angle) between themselves and the transverse axis 6 (rectilinear transverse corrugations), the deformation zones 8*b* of the odd sheets are preferably superposed with the deformation zones of the even sheets in order to limit head losses.

As shown in FIG. 2C, it is also possible to provide gaps 9 obtained while making the second corrugations 5 in order to limit the head loss in the fluids flowing through the heat exchanger in the deformation zones. These gaps 9 are obtained by making the second corrugations 5 in discontinuous manner.

Heat exchanger plates of the invention thus enable deformation to be absorbed in the longitudinal direction, and in particular deformation due to thermal expansion of the sheets, without stresses appearing in the main portions of the sheets between the deformation zones.

The absorption of deformation due to thermal or mechanical stresses in the sheets of a heat exchanger in operation by means of the deformation zone also serves to limit stresses in the heat exchanger bundle(s) constituted by a stack of sheets of the invention.

This effect whereby sheet deformation is absorbed in the longitudinal direction can be obtained in a manner that is entirely satisfactory when using deformation zones that are constituted by transverse corrugations of total area representing 5% to 10% of the total area of the longitudinal corrugations of the sheets.

The invention is not limited to the embodiments described above.

Thus, the longitudinal or transverse corrugations may be of shapes other than those described, the transverse corrugations may extend along alignment axes that make any angle in the range 45° to 90° relative to the axes of the longitudinal corrugations of the plates, and the deformation zones of the plates may be constituted by at least one transverse corrugation.

The number of deformation zones along the length of the sheet may be arbitrary and determined as a function of the total length of the heat exchanger plates and the width and number of transverse corrugations in each deformation zone.

The distances between the deformation zones in the longitudinal direction may be constant over the entire length of the heat exchanger plates, or on the contrary they may differ.

In all cases, deformation calculations serve to determine an optimum solution concerning the number of deformation zones and the distances between said zones as a function of the total length of the heat exchanger plates and as a function of the temperatures of the fluids flowing in contact with the plates of the heat exchanger.

The invention may be applied to numerous kinds of plate heat exchanger used in industry.

What is claimed is:

1. A plate for a heat exchanger constituted by a stack of plates, each plate comprising a central zone in which it presents adjacent first corrugations directed generally along respective alignment axes in the longitudinal direction of the plate and comprising successive segments that are substantially rectilinear and oblique, being successively in a first sense and in a second sense relative to their longitudinal alignment axis, the plate further including at least one set of successive segments of second corrugations extending along respective alignment axes of generally transverse direction and intersecting the set of longitudinal axes along which the first corrugations are disposed, the segments of the second corrugations being angular or in alignment to one another and the transverse alignment axes of substantially rectilinear segments of the second corrugations making an angle lying in the range 45° to 90° with the longitudinal axes of the first corrugations; wherein the second corrugations of generally transverse direction intersect the first corrugations in zones of the rectilinear segments of the first corrugations that are situated between the ends of said segments.

2. A heat exchanger plate according to claim 1, including at least two deformation zones each constituted by at least one set of second corrugation segments.

3. A heat exchanger plate according to claim 2, wherein each of the deformation zones has at least two adjacent second corrugations extending in the transverse direction of the heat exchanger plate.

4. A heat exchanger plate according to claim 3, wherein the heat exchanger plate includes a plurality of deformation zones disposed successively in the longitudinal direction of the heat exchanger plate, with constant spacing between pairs of successive deformation zones.

5. A heat exchanger plate according to claim 3, including a plurality of deformation zones distributed along the longitudinal direction of the heat exchanger plate in such a manner that successive deformation zones are spaced apart in the longitudinal direction by varying distances along the length of the heat exchanger plate.

6. A heat exchanger bundle constituted by a stack of plates according to claim 1.

7. A heat exchanger bundle according to claim 6, wherein each of the plates of the heat exchanger bundle has at least two deformation zones disposed in positions such that the deformation zones in the longitudinal direction of two successive plates in the stack are not superposed in the stack of plates of the set of plates.

8. A plate for a heat exchanger constituted by a stack of plates, each plate comprising a central zone in which it presents adjacent first corrugations directed generally along respective alignment axes in the longitudinal direction of the plate and comprising successive segments that are substantially rectilinear and oblique, being successively in a first sense and in a second sense relative to their longitudinal alignment axis, the plate further including at least one set of successive segments of second corrugations extending along respective alignment axes of generally transverse direction and intersecting the set of longitudinal axes along which the first corrugations are disposed, the segments of the second corrugations being angular or in alignment to one another and the transverse alignment axes of substantially rectilinear segments of the second corrugations making an angle lying in the range 45° to 90° with the longitudinal axes of the first corrugations; wherein the second corrugations intersect the first corrugations in junction zones between successive segments of the first corrugations.

9. A plate for a heat exchanger constituted by a stack of plates, each plate comprising a central zone in which it presents adjacent first corrugations directed generally along respective alignment axes in the longitudinal direction of the plate and comprising successive segments that are substantially rectilinear and oblique, being successively in a first sense and in a second sense relative to their longitudinal alignment axis, the plate further including at least one set of successive segments of second corrugatioms extending along respective alignment axes of generally transverse direction and intersecting the set of longitudinal axes along which the first corrugations are disposed, the segments of the second corrugations being angular or in alignment to one another and the transverse alignment axes of substantially rectilinear segments of the second corrugations making an angle lying in the range 45° to 90° with the longitudinal axes of the first corrugations; wherein the second corrugations are discontinuous and comprise successive different portions in the transverse direction separated by zones in which the heat exchanger plate does not have second corrugations.

* * * * *